US006691319B1

(12) United States Patent
Simon

(10) Patent No.: US 6,691,319 B1
(45) Date of Patent: Feb. 17, 2004

(54) SIMULATED NECKTIE KNOT

(76) Inventor: Raphael Simon, 274 E. 32nd St., Apt. 2, Brooklyn, NY (US) 11226

( * ) Notice: Subject to any disclaimer, the term of this patent is extended or adjusted under 35 U.S.C. 154(b) by 85 days.

(21) Appl. No.: 10/115,738

(22) Filed: Apr. 3, 2002

(51) Int. Cl.[7] ..... A41D 25/00
(52) U.S. Cl. ..... 2/144
(58) Field of Search ..... 2/144, 145, 146, 2/147, 148, 149, 150, 151, 152.1, 153, 154, 155, 156, 157; D2/600, 602, 605, 606, 607, 609

(56) References Cited

U.S. PATENT DOCUMENTS

| | | | | | |
|---|---|---|---|---|---|
| 363,862 | A | * | 5/1887 | Tintrop | 2/150 |
| 1,227,677 | A | * | 5/1917 | Schloerb | 2/148 |
| 1,396,240 | A | * | 11/1921 | Bakerman | 2/150 |
| 1,705,414 | A | * | 3/1929 | Meling | 24/66.3 |
| 2,294,508 | A | * | 9/1942 | Minor | 2/150 |
| 2,411,753 | A | * | 11/1946 | Pfau | 2/148 |
| 2,565,149 | A | * | 8/1951 | Shea | 2/153 |
| 2,605,473 | A | * | 8/1952 | Halsey | 2/153 |
| 2,728,081 | A | * | 12/1955 | Zele | 2/153 |
| 3,346,881 | A | * | 10/1967 | Mathison | 2/150 |
| 3,526,004 | A | * | 9/1970 | Brandenberger | 2/150 |
| 3,735,420 | A | * | 5/1973 | New | 2/150 |
| 3,745,614 | A | * | 7/1973 | Tsang | 2/148 |
| 3,942,191 | A | | 3/1976 | Hunnicutt | 2/145 |
| 4,035,873 | A | * | 7/1977 | Epperson | 24/66.9 |
| 4,173,792 | A | * | 11/1979 | Intengan | 2/144 |
| 4,318,189 | A | * | 3/1982 | Intengan | 2/144 |
| 4,542,537 | A | * | 9/1985 | Plapp et al. | 2/148 |
| 4,575,872 | A | * | 3/1986 | Chen | 2/144 |
| 4,771,481 | A | * | 9/1988 | Gasser | 2/152.1 |
| 4,875,239 | A | * | 10/1989 | Patterson, Jr. | 2/153 |
| 4,995,118 | A | * | 2/1991 | Paduano, Sr. | 2/150 |
| 5,010,593 | A | * | 4/1991 | Stevens, Jr. | 2/153 |
| 5,035,002 | A | * | 7/1991 | Knight, Jr. | 2/153 |
| 5,084,916 | A | * | 2/1992 | Austin | 2/149 |
| 5,088,120 | A | * | 2/1992 | Yen | 2/153 |
| 5,216,757 | A | | 6/1993 | Dorkin | 2/152 |
| 5,390,370 | A | * | 2/1995 | Koy | 2/153 |
| 5,400,439 | A | * | 3/1995 | Petroff | 2/148 |
| 5,416,925 | A | * | 5/1995 | Davis | 2/144 |
| 5,416,926 | A | | 5/1995 | Koy | 2/153 |
| 5,493,731 | A | | 2/1996 | Amnott | 2/148 |
| 5,555,563 | A | | 9/1996 | Ear | 2/148 |
| 5,584,075 | A | * | 12/1996 | Bae et al. | 2/152.1 |
| 5,600,852 | A | * | 2/1997 | Densch | 2/144 |
| 5,664,297 | A | * | 9/1997 | Mandukian | 24/66.9 |
| 5,666,666 | A | * | 9/1997 | Chaffen et al. | 2/148 |
| 5,673,434 | A | * | 10/1997 | Risk | 2/144 |
| 5,778,453 | A | * | 7/1998 | Chen | 2/148 |
| 5,836,018 | A | * | 11/1998 | Lee | 2/144 |
| 5,920,907 | A | * | 7/1999 | Pierce | 2/152.1 |
| 5,953,755 | A | * | 9/1999 | Barylski | 2/148 |
| 6,094,746 | A | * | 8/2000 | Miller | 2/152.1 |
| 6,205,586 | B1 | * | 3/2001 | Jenkins et al. | 2/145 |
| 6,305,025 | B1 | * | 10/2001 | Pilon | 2/145 |
| 6,363,533 | B1 | * | 4/2002 | DeLuca | 2/152.1 |
| 6,367,127 | B1 | * | 4/2002 | Lee | 24/66.3 |
| 6,401,251 | B1 | * | 6/2002 | Fredenberg | 2/144 |
| 6,460,189 | B1 | * | 10/2002 | Welch | 2/145 |

* cited by examiner

*Primary Examiner*—John J. Calvert
*Assistant Examiner*—Alissa L. Hoey
(74) *Attorney, Agent, or Firm*—Goldstein Law Offices P.C.

(57) ABSTRACT

A simulated necktie knot for use with a necktie to create a necktie knot without necessitating the hand-tying of a knot. The simulated necktie knot has a flexible funnel shaped cup, simulating a necktie knot, and a rigid funnel shaped core that fits within the cup. The core is used to fill the space within the cup not otherwise occupied by the necktie. A clip, positioned within the cup, holds the necktie in place within the cup. An adjustable collar strap may be used with the simulated necktie knot to attached the tie around the user's neck.

4 Claims, 4 Drawing Sheets

SIMULATED NECKTIE KNOT

BACKGROUND OF THE INVENTION

The invention relates to a simulated necktie knot. In particular, the invention is a simulated necktie knot that may be use in conjunction with a standard necktie to give the appearance of a necktie knot without necessitating the need to hand-tie a knot.

Neckties are a popular fashion accessory for men and are typically worn with a dress shirt. Many men find it a difficult and time consuming task to tie a neat knot in the necktie. It is often necessary for a man to engage the aid of another person or to use a mirror to correctly tie a knot. Further, people with disabilities can find it cumbersome to perform such a task.

To alleviate these problems, there have been alternative ties offered to men. Two such alternatives are the clip-on ties and the neckties with pre-tied knots.

When wearing ties everyday, the wearer often gets bored with his selection of neckties. However, because of the construction of a tie, it has thus far been impossible to change a tie or any portion thereof.

Thus, there exists a need for a necktie accessory that would allow a man to create a perfect consistent tie knot with little effort and no assistance from others. The accessory should also allow a man to alternate different styled and colored knots with his ties to offer a unique variety in his wardrobe.

U.S. Pat. No. 3,942,191 to Hunnicutt discloses a snap-on necktie and device for covering an ordinary four-in-hand necktie for snap-on usage. The necktie, as disclosed, requires a wearer to hand-tie the necktie in the usual fashion, but allows a wearer to remove the tie while leaving the knot intact.

U.S. Pat. No. 5,216,757 to Dorkin discloses a knot simulating necktie clasp. The necktie is wrapped around the wearer's neck and the tie knot apparatus is then applied over the overlapping ends of the tie.

U.S. Pat. No. 5,416,926 to Koy discloses a pre-tied necktie knot support. The support has a triangular shaped front face with a V-shaped upper portion to form a tight knot, while hiding the back portion of the knot.

U.S. Pat. No. 5,493,731 to Amnott discloses a necktie accessory having a simulated knot which is slidable for adjustment of the necktie.

While these units may be suitable for the particular purpose employed, or for general use, they would not be as suitable for the purposes of the present invention as disclosed hereafter.

SUMMARY OF THE INVENTION

In view of the foregoing disadvantages inherent in the prior art, the present invention provides an improved simulated necktie knot. As such, the general purpose of the present invention, which will be described subsequently in greater detail, is to provide a new and improved simulated necktie knot which has all the advantages of the prior art and none of the disadvantages.

To attain this, the present invention essentially comprises a simulated necktie knot for use with a necktie to create a necktie knot without necessitating the hand-tying of a knot. The simulated necktie knot has a flexible funnel shaped cup, simulating a necktie knot, and a rigid funnel shaped core that fits within the cup. The core is used to fill the space within the cup not otherwise occupied by the necktie. A clip, positioned within the cup, holds the necktie in place within the cup. An adjustable collar strap may be used with the simulated necktie knot to attached the tie around the user's neck.

It is an object of the invention to produce a simulated necktie knot that would provide a user with an instant knot without the wearer having to hand-tie same. Accordingly, the tie is mated with the simulated necktie knot and the device may then be adjusted according to the user's neck size.

It is a further object of the invention to produce a simulated necktie knot that would allow a wearer to change the look of his ties by alternating the color of the knot portion of the necktie. Accordingly, the simulated necktie knot is available in a wide variety of colors and styles to suit an individual's preference, as well as the tie with which it is to be combined.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

Reference Numerals

Figure 1:
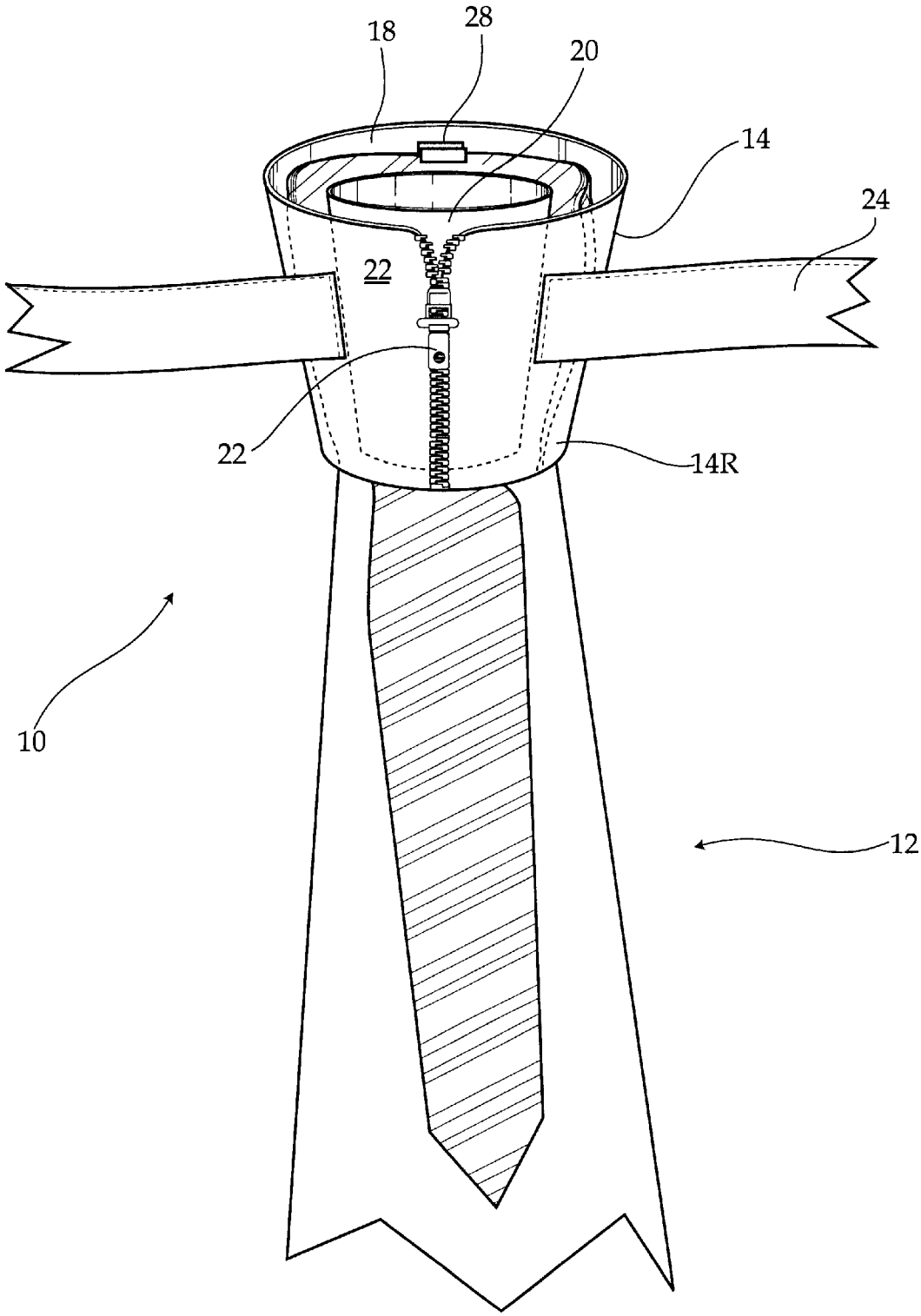
FIG. 1 is a perspective view of a simulated necktie knot mated with a necktie.
Figure 2:
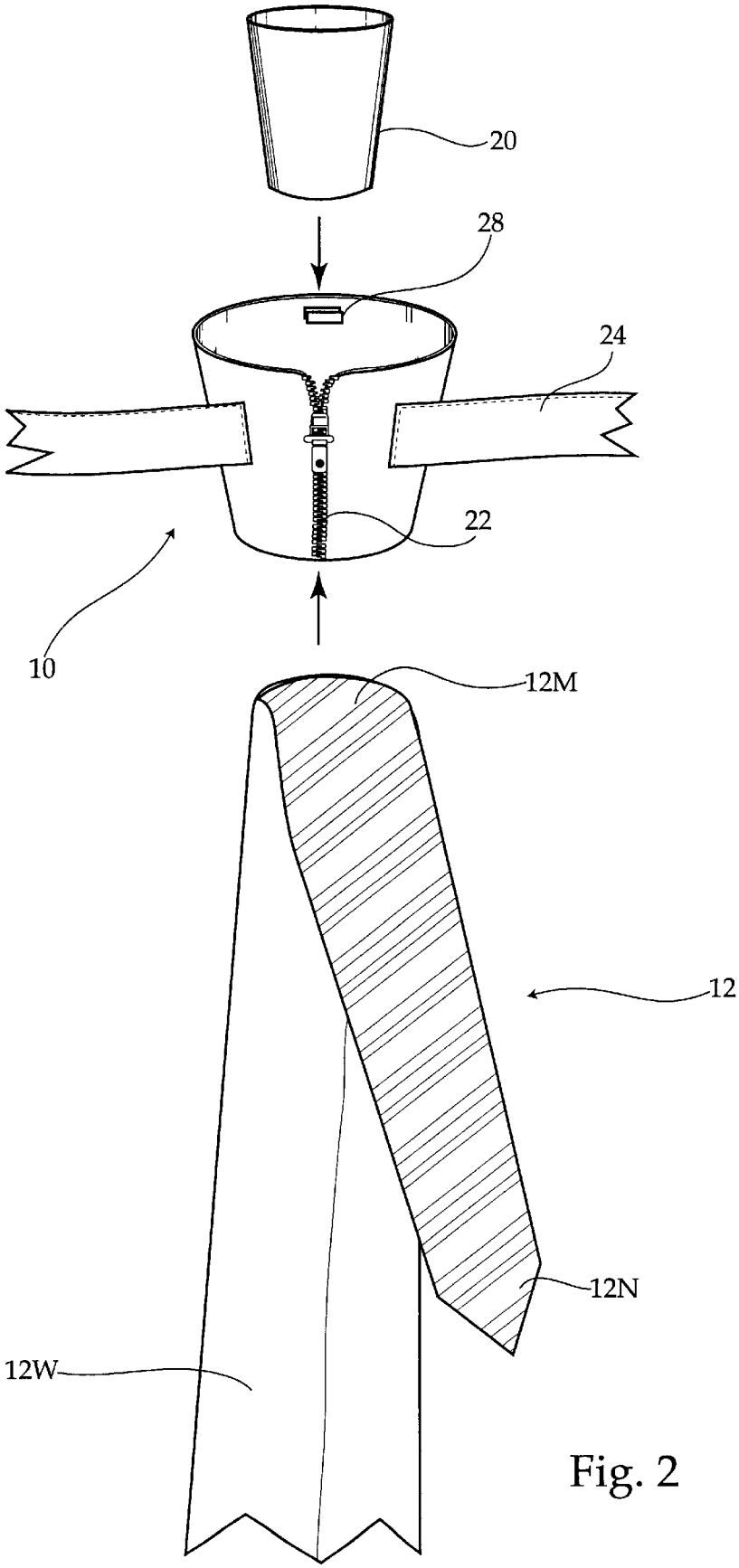
FIG. 2 is an exploded view of the simulated necktie knot used with a necktie.
Figure 3:
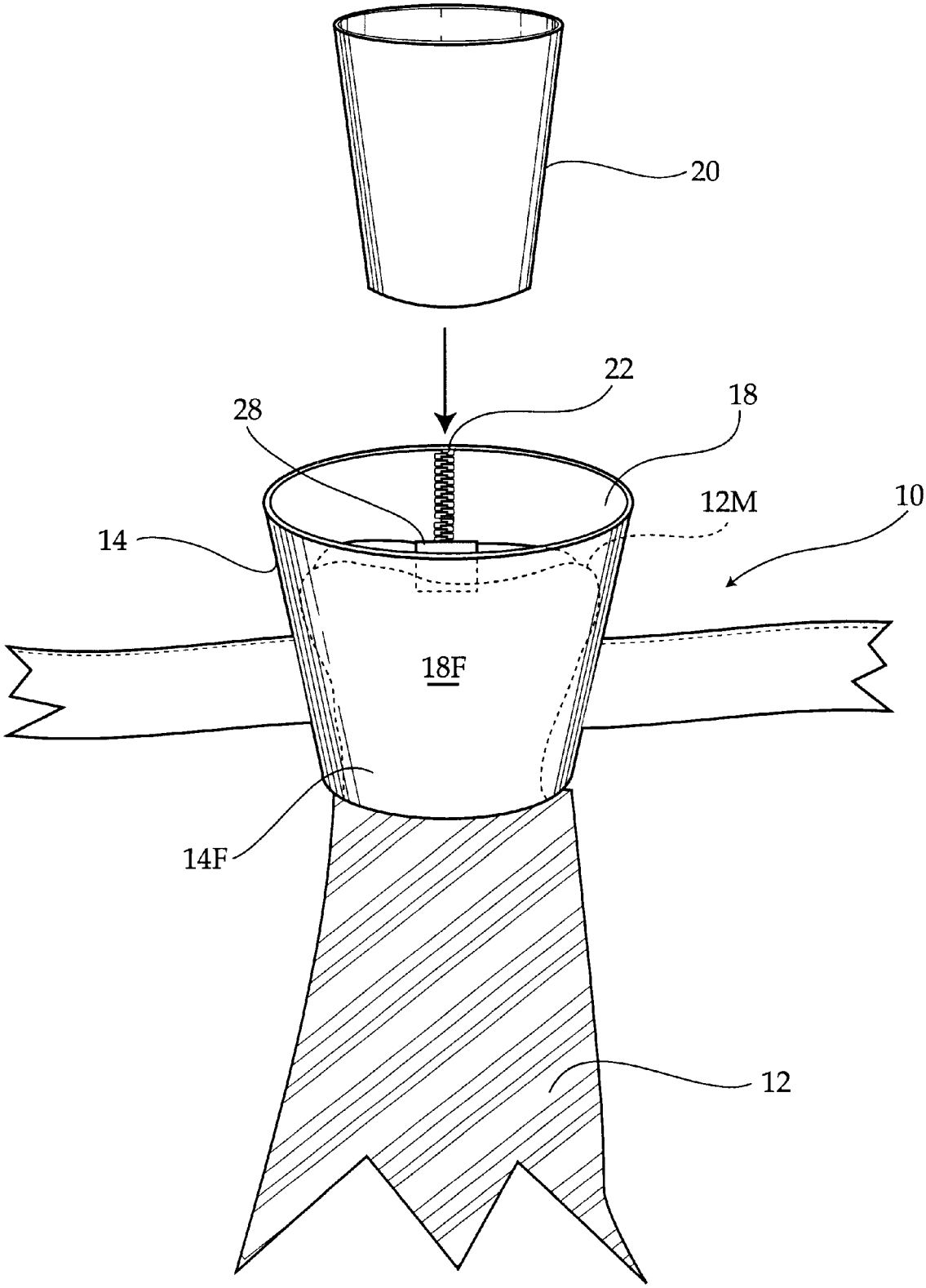
FIG. 3 is a perspective view of the simulated necktie knot being secured about a necktie.
Figure 4:
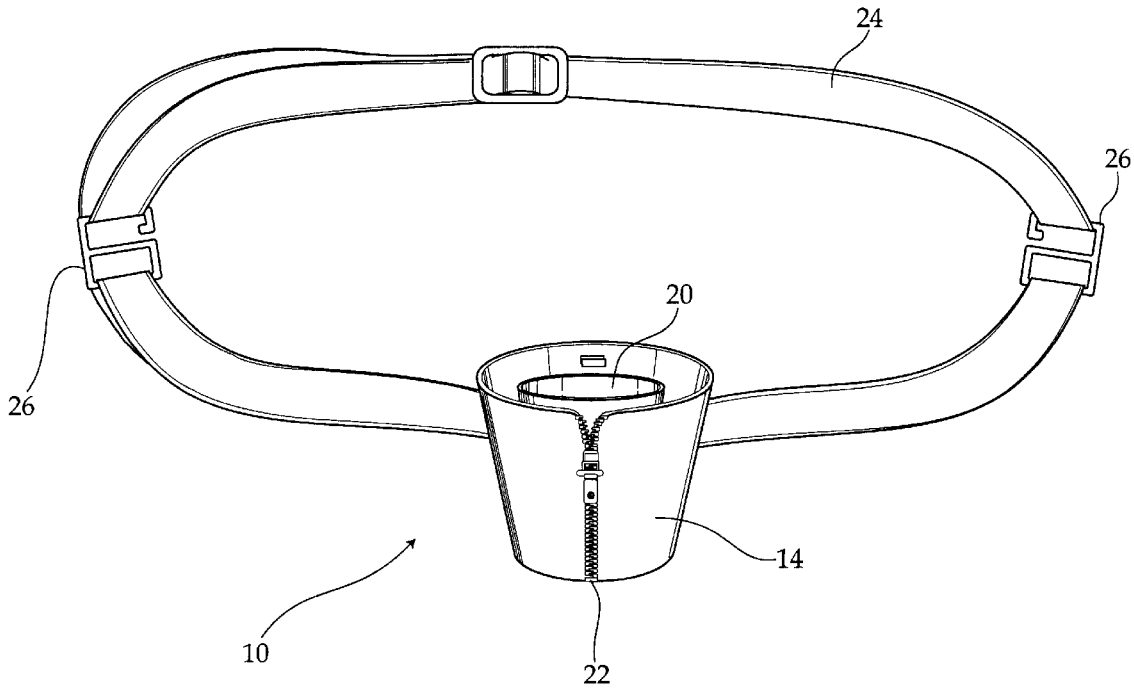
FIG. 4 is a perspective view of the simulated necktie knot.

10 simulated necktie knot
12 standard necktie
12W wide end of necktie
12N narrow end of necktie
12M middle section of necktie
14 cup
14F front side of cup
14R rear side of cup
16 outer surface of cup
18 inner surface of cup
20 core
22 zipper
24 adjustable collar strap
26 hooks of strap
28 clip in cup

DETAILED DESCRIPTION OF THE PREFERRED EMBODIMENTS

FIG. 1 illustrates a simulated necktie knot 10 mated with a standard necktie 12. The necktie 12 is an elongated strip of fabric which tapers from one end to the other, said necktie 12 having a wide end 12W, a narrow end 12N, and a middle section 12M therebetween. When worn, the middle section 12M is typically wrapped around a user's neck, positioned beneath a shirt collar. A standard hand-tied knot is made by tying the two ends 12W, 12N, said knot tightened to the user's neck. The ends 12W, 12N hang down vertically therefrom on the user's chest, with the narrow end 12N of the necktie 12 positioned behind the wide end 12W.

The simulated necktie knot 10 essentially comprises a cup 14, simulating a necktie knot, and a core 20 that fits within the cup 14. The cup 14 is constructed from a flexible material similar to the material used in the necktie 12. The cup 14 is funnel shaped, having an outer surface 16, an inner surface 18, a front side 14F, and a rear side 14R. A zipper 22 extends vertically down the rear side 14R of the cup 14, and allows the cup 14 to be wrapped around the middle section 12M of the necktie 12.

The core 20, also funnel shaped, has a smaller diameter than the cup 14 and fits therein. The core 20 is constructed from a rigid material, preferably plastic, and is employed to fill the space within the cup 14 not otherwise occupied by the necktie 12. Without the core 20 in place, the cup 14 would cave inward and ruin the appearance of the simulated necktie knot 10. A clip 28 is positioned within the inner surface 18 of the cup 14, along the front side 14F. When the middle section 12M of the necktie 12 is in place within the cup 14, the clip 28 is used to hold the necktie 12 in place.

An adjustable collar strap 24 is attached to the outer surface 16 of the rear side 14R of the cup 14, and allows the user to lengthen or shortened the strap 24 according to his neck size. The strap 24 has a pair of hooks 26 along its length. Once the necktie 12 is properly mated with the simulated necktie knot 10, one of the hooks 26 may be unattached, allowing the user is able to extend the strap 24 around his neck. The hook 26 is then refastened to secure the necktie 12 in place. Alternatively, the strap 24 may be placed over the use's head and adjusted once in place around his neck.

The simulated necktie knot 10 may be available in a wide variety of colors and patterns and may be selected by the user according to the color and style of the necktie 12 with which it will be worn.

In use, the necktie 12 is folded along its middle section 12M, with the wide end 12W resting on top of the narrow end 12N. The lengths of the ends 12W, 12N are adjusted to allow the necktie 12 to fall from the user's neck to the waistband of his pants, as is the usual fashion. The cup 14 of the simulated necktie knot 10 is opened up by unfastening the zipper 22 along the rear side 14R of said cup 14. The folded middle section 12M of the necktie 12 is then encapsulated within the cup 14, and placed under the clip 28. The zipper 22 is then refastened. The necktie middle section 12M is forced towards the front side 12F of the cup 14 while the core 20 is wedged into the cup 14. With the core 20 in place, the necktie 12 is secured within the cup 14. The necktie 12, with the simulated necktie knot 10, is then ready to be worn by the user. One of the hooks 26 along the adjustable strap 24 is unfastened and the strap 24 is positioned around the user's neck, under his shirt collar. Once in place, the hook 26 is refastened to secure the necktie 12 in place. The user is left with a necktie 12 having a perfectly shaped knot.

Alternatively, the simulated necktie knot 10 may be employed with a necktie 12 that is hand-tied around the user's neck. In this instance, the simulated necktie knot 10 is fastened to the necktie 12 in a similar fashion as described above, however the necktie 12 is hand-tied. The necktie 12 is wrapped around the user's neck and tied in a traditional method. The cup 14 is then folded around the tied knot in the necktie 12. The adjustable strap 24 would not be used. The user may employ this means in order to match a different colored or styled knot with the chosen necktie 12.

In conclusion, herein is presented a simulated necktie knot 10. The invention is illustrated by example in the drawing figures, and throughout the written description. It should be understood that numerous variations are possible, while adhering to the inventive concept. Such variations are contemplated as being a part of the present invention.

What is claimed is:

1. A simulated necktie knot for use with a necktie, comprising:

a cup, the cup having a flexible funnel shape to simulate a necktie knot, said cup having a front side, a rear side, an inner surface, and an outer surface, the cup having a zipper running vertically down the rear side for allowing insertion of the necktie, the cup further having a clip positioned on the inner surface of the cup along the front side for securing the necktie in place within the cup, wherein the cup is mated with the necktie in a fashion to create the appearance of a completed necktie knot on the necktie;

a cone, the cone having a rigid funnel shape with a smaller diameter than the cup for fitting within the cup, said cone filling the space within the cup not otherwise occupied by the necktie to prevent the cup from caving inward and ruining the appearance of the simulated necktie knot.

2. The simulated necktie knot as recited in claim 1, further comprising an adjustable strap connected to the outer surface of the rear side of the cup, said strap capable of being lengthened or shortened according to the user's neck size.

3. The simulated necktie knot as recited in claim 2, wherein the adjustable strap further comprises a pair of hooks positioned along the strap's length, said hooks capable of being unfastened in order to allow the user to extend the strap around his neck without placing said strap over his head.

4. A method of creating a simulated necktie knot on a necktie, the necktie having a wide end, a narrow end, and a middle section therebetween, the simulated necktie knot comprising a cone, and a cup having an inner surface, a front side, a rear side, a zipper extending vertically down the rear side, and a clip positioned on the inner surface at the front side of the cup, comprising the steps of:

folding the necktie along the middle section;

positioning the necktie ends so the necktie is the proper length and the wide end is on top of the narrow end;

mating the simulated necktie knot with the necktie by:

unfastening the cup by unzippering the rear side thereof;

placing the cup around the middle section of the necktie so that the cup encapsulates the middle section;

rotating the cup to ensure that the front side is aligned with the wide end of the necktie, and the rear side of the cup is aligned with the narrow end of the necktie;

placing the middle section of the necktie under the clip;

fastening the cup by zippering the rear side thereof;

wedging the cone into the space of the cup not occupied by the necktie; and strapping the necktie and simulated necktie knot in place around the user's neck.

* * * * *